US007575843B2

(12) United States Patent
Matsumoto et al.

(10) Patent No.: US 7,575,843 B2
(45) Date of Patent: Aug. 18, 2009

(54) METHOD OF MANUFACTURING TONER AND TONER

(75) Inventors: Katsuru Matsumoto, Nara (JP); Yasuhiro Shibai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 252 days.

(21) Appl. No.: 11/652,482

(22) Filed: Jan. 12, 2007

(65) Prior Publication Data

US 2007/0166638 A1 Jul. 19, 2007

(30) Foreign Application Priority Data

Jan. 13, 2006 (JP) ..... P2006-006544

(51) Int. Cl.
*G03G 9/08* (2006.01)

(52) U.S. Cl. ..... 430/137.15; 430/137.18

(58) Field of Classification Search ..... 430/137.15, 430/137.18

See application file for complete search history.

(56) References Cited

U.S. PATENT DOCUMENTS 5,424,162 A 6/1995 Kohri et al.
5,552,502 A * 9/1996 Odell et al. ..... 526/234
5,725,987 A * 3/1998 Combes et al. ..... 430/137.11
5,843,614 A 12/1998 Shinzo et al.
6,858,369 B1 * 2/2005 Adachi et al. ..... 430/137.11
2005/0041523 A1 2/2005 Nakano

FOREIGN PATENT DOCUMENTS

JP 08-146657 6/1996
JP 09-277348 10/1997
JP 2005-165039 6/2005

* cited by examiner

*Primary Examiner*—John L Goodrow
(74) *Attorney, Agent, or Firm*—Nixon & Vanderhye P.C.

(57) ABSTRACT

A toner is manufactured by way of a coarse particle preparing step, a slurry preparing step, a pulverizing step, a cooling step, and a depressurizing step. Slurry of toner coarse particles obtained by way of the coarse particle preparing step and the slurry preparing step is made to pass under heat and pressure through a pressure-resistant nozzle whereby toner coarse particles are pulverized into diameter-reduced toner particles. By providing the cooling step immediately after the pulverizing step, dispersion of wax component into the toner particles is promoted. And by further providing the depressurizing step, bubbling and coarsening of the toner particles due to the bubbling are prevented. By so doing, there is obtained a diameter-reduced toner particle in which wax is evenly dispersed and which does not cause bleeding out.

8 Claims, 1 Drawing Sheet

METHOD OF MANUFACTURING TONER AND TONER

CROSS-REFERENCE TO RELATED APPLICATION

This application claims priority to Japanese Patent Application No. JP 2006-6544, which was filed on Jan. 13, 2006, the contents of which, are incorporated herein by reference, in their entirety.

BACKGROUND OF THE INVENTION

1. Field of the Invention

The present invention relates to a method of manufacturing a toner, and to a toner.

2. Description of the Related Art

An electrophotographic image forming apparatus comprises an image forming process mechanism including a photoreceptor; a charging section for charging a photoreceptor surface; an exposing section for irradiating with signal light the photoreceptor surface being charged, to form thereon an electrostatic latent image corresponding to image information; a developing section for supplying a toner contained in a developer to the electrostatic latent image formed on the photoreceptor surface, to form thereon a toner image; a transfer section provided with a transfer roller for transferring the toner image from the photoreceptor surface to a recording medium; a fixing section provided with a fixing roller for fixing the toner image onto the recording medium; and a cleaning section for cleaning the photoreceptor surface from which the toner image has been transferred. In the electrophotographic image forming apparatus, the electrostatic latent image is developed by use of a one-component developer containing a toner as a developer or by use of a two-component developer containing toner and carrier as developers so that an image is formed.

Through the electrophotographic image forming apparatus, an image of favorable image quality can be formed at high speed and low cost. This promotes the use of the electrophotographic image forming apparatus in a copier, a printer, a facsimile, or the like machine, resulting in a remarkable spread thereof in recent years. Simultaneously, the image forming apparatus has faced up to more demanding requirements. Among such requirements, particular attentions are directed to enhancement in definition and resolution, stabilization of image quality, and an increase in image forming speed, regarding an image being formed by the image forming apparatus. In order to fulfill these demands, a two-way approach is indispensable in view of both the image forming process and the developer.

Regarding the enhancement in definition and resolution of the image, the reduction in diameter of toner particles is one of problems to be solved from the aspect of the developer. This is based on the perspective such that it is important to authentically reproduce the electrostatic latent image. Typically, the toner particles are resin particles formed of wax which serves as a colorant or releasing agent, dispersed in binder resin serving as a matrix. It is thus difficult to reduce the diameter of the wax dispersed in the binder resin by a commonly-used method of manufacturing diameter-reduced toner particles. In this case, a problem arises such that the diameter-reduced toner particle thus manufactured has its wax bleeding out over time, thus causing toner filming on a photoreceptor. In addition, a large amount of wax bleeds out onto a surface of the toner particle, and particularly when the temperature is high, the wax is fused and thus exhibits viscosity. Consequently, this makes it extremely easy to cause an offset phenomenon that the toner is not transferred or fixed onto a recording medium but attached to a transfer roller, a fixing roller, or the like component.

As a method of reducing the diameter of the wax, a toner manufacturing method including a mixing step, a melt-kneading step, and a pulverizing-classifying step has been proposed, for example (refer to Japanese Unexamined Patent Publication JP-A 6-161153 (1994), for example). In this method, at least 100 parts by weight of thermoplastic resin and 1 to 7 parts by weight of wax are mixed at the mixing step. The melt-kneading step is a step for melting and kneading the admixture obtained at the mixing step, where a melt-kneading temperature falls in a range of from (Tm−20)° C. to (Tm+20)° C. wherein Tm represents a melting temperature of the thermoplastic resin, and a temperature of melt-kneaded product after the melt-kneading process is (Tm+35)° C. or less. Further at the pulverizing-classifying step, the melt-kneaded product-obtained at the melt-kneading step is cooled down to be then pulverized and classified.

Further, there has been proposed a toner manufacturing method composed of melt-kneading an admixture of toner raw material, and cooling down, pulverizing and classifying the obtained melt-kneaded product, the toner manufacturing method in which the admixture of toner raw material is melt-kneaded by using a kneading extruder configured such that a slide-shaped discharging portion inclining downward is coupled on an outlet of a cylinder portion having a kneading-conveying member therein for kneading and conveying the admixture of toner raw material (refer to Japanese Unexamined Patent Publication 9-277348 (1997)).

In the above manufacturing methods, the diameter of the wax contained in the toner particles is reduced whereby the toner filming on the photoreceptor caused by bleeding out of the wax and the offset phenomenon are aimed to be prevented. These methods which are basically the heretofore known melt-kneading methods may succeed in reducing the diameter of the wax, but fail to contribute to sufficient reduction of the toner particle itself. Accordingly, the toner particles obtained through these methods are not fully satisfactory in terms of the image reproducibility including definition and resolution in particular.

Meanwhile, there has been proposed an emulsifying/dispersing apparatus comprising: an emulsifying/dispersing section for emulsifying/dispersing by a shearing force an emulsifying material in a liquid serving as a matrix; a leading passage for supplying a multistage depressurization section with the pressurized emulsified liquid obtained by the emulsifying/dispersing section; a heat exchanging section disposed on the leading passage; and a multistage depressurization section for allowing the emulsified liquid supplied from the leading passage to have a reduced pressure causing no bubbling even if it is released to atmosphere, and then discharging the emulsified liquid (refer to International Publication WO03/059497, for example). In the emulsifying/dispersing apparatus, the emulsifying material is dispersed in a liquid under pressure, thereby preparing the emulsified liquid in which the emulsifying material is evenly dispersed. Next, the pressure on the emulsified liquid is reduced in a stepwise manner so that the final pressure is at a level causing no bubbling. By so doing, particles of the emulsifying material dispersed in the emulsified liquid are prevented from coarsening. The emulsifying/dispersing apparatus thus aims to obtain an emulsified liquid in which particles of emulsifying material having a uniform particle diameter are dispersed. By use of this emulsifying/dispersing apparatus which has the multistage depressurization section, a large shearing force can be given by the emulsifying/dispersing section, so that an emulsion of water/oil, for example, can be easily manufactured. However, on attempts to obtain toner particles by use of this apparatus only, it is difficult to control the particle diameter, so that desired toner particles with a reduced diameter cannot be obtained. Further, WO03/059497 has no disclosure about application of this emulsifying/dispersing apparatus to a manufacture of toner particles. Furthermore, WO03/059497 has no suggestion about the effect that the use of this emulsifying/dispersing apparatus in manufacturing the toner particles makes it possible to obtain a toner in which not only a diameter of toner particle is reduced but also wax contained in the toner particles, having more reduced diameter than that of the toner particle is evenly dispersed.

SUMMARY OF THE INVENTION

An object of the invention is to provide a toner which is excellent in image reproducibility and capable of forming a high-definition and high-resolution image of high quality, and which prevents toner filming on a photoreceptor caused by bleeding out of wax, and an offset phenomenon in a high temperature, as well as a method of manufacturing the toner.

The inventor has devised the invention through keen studies for solving the above problems. As a result of the studies, it turned out that a desired toner can be obtained not by merely giving a shearing force to water-based slurry containing coarse particles of toner raw material, but by letting the water-based slurry under heat and pressure pass through a pressure-resistant nozzle to thereby pulverize the coarse particles of toner raw material and then cooling down the obtained water-based slurry, followed by stepwise depressurization.

The invention provides a method of manufacturing a toner comprising:

a coarse particle preparing step for coarsely pulverizing a melt-kneaded product of toner raw material;

a slurry preparing step for obtaining coarse particle slurry by adding and dispersing coarse particles of toner raw material obtained at the coarse particle preparing step, in a liquid;

a pulverizing step for obtaining heated and pressurized slurry containing toner particles by passing the coarse particle slurry obtained at the slurry preparing step through a pressure-resistant nozzle under heat and pressure and pulverizing the coarse particles of toner raw material;

a cooling step for cooling down the heated and pressurized slurry containing toner particles, obtained at the pulverizing step; and a depressurizing step for gradually depressurizing the pressurized slurry containing toner particles, cooled down at the cooling step, to a pressure level at which no bubbling is caused.

According to the invention, a toner manufacturing method comprises a coarse particle preparing step, a slurry preparing step, a pulverizing step, a cooling step, and a depressurizing step. At the pulverizing step, the slurry of toner coarse particles obtained at the slurry preparing step is made to pass under heat and pressure through the pressure-resistant nozzle so that the toner coarse particles are pulverized, thus preparing slurry of the toner particles and further cooling down the slurry at the cooling step, followed by depressurization of the slurry at the depressurizing step to a pressure level at which no bubbling is caused. By so doing, at respective steps, bubbles are prevented from arising, and the toner particles are thus prevented from coarsening. Accordingly, by use of the manufacturing method of the invention, it is possible to obtain uniformly-shaped toner particles having reduced diameter which falls in a range of from 3.5 to 6.5 μm, for example. Furthermore, the adoption of the cooling step after pulverization of the toner coarse particles contributes to even dispersion of wax having a reduced diameter in a range of around 30 to 300 nm, for example, into the diameter-reduced toner particles. The toner is, by virtue of reduction of its diameter, excellent in reproducibility of an original image and capable of forming a high-definition and high-resolution image of high quality. Moreover, the reduction in diameter of the wax makes it very difficult to cause bleeding out of the wax, thus preventing the toner filming on the photoreceptor and the offset phenomenon in a high temperature. Furthermore, the use of the toner in performing the image formation allows enhancement in transfer efficiencies of the toner image which is transferred from a photoreceptor to a recording medium, from the photoreceptor to an intermediate medium, and from the intermediate medium to the recording medium, with the result that the reduction of toner consumption can be achieved.

Further, in the invention, it is preferable that the liquid in which coarse particles of toner raw material are added and dispersed at the slurry preparing step is water.

According to the invention, water is used as the liquid for dispersion of the coarse particles of toner raw material at the slurry preparing step, in a consequence whereof controls over the following steps can be simplified and moreover, waste liquid can be easily disposed after the manufacture of the toner particles. The use of water thus leads enhancement in productivity of the toner particles, therefore contributing to cost reduction.

Further, in the invention, it is preferable that the liquid in which the coarse particles of toner raw material are added and dispersed at the slurry preparing step is water containing a polymeric dispersant.

According to the invention, water containing a polymeric dispersant is used as the liquid for dispersing the coarse particles of toner raw material at the slurry preparing step, in a consequence whereof the coarsening of the toner particles due to generation of bubbles is notably prevented at the steps following the slurry preparing step, thus achieving further reduction in diameter of the toner particles finally obtained, further equalization of the diameters of the toner particles, and further simplification of the controls over the steps.

Further, in the invention, it is preferable that the slurry obtained at the slurry preparing step is pressurized at a pressure in a range from 50 MPa to 250 MPa, and heated to 50° C. or more at the pulverizing step.

Further, in the invention, it is preferable that the slurry obtained at the slurry preparing step is pressurized at a pressure in a range from 50 MPa to 250 MPa, and heated to 90° C. or more at the pulverizing step.

According to the invention, the slurry obtained at the slurry preparing step is pressurized to 50 Mpa or more and 250 MPa or less and heated to 50° C. or more (preferably 90° C. or more) at the pulverizing step, in a consequence whereof bubble generation is absolutely smaller than a level at which the particle diameter of the toner particle is affected by the bubbles, thus further facilitating the control over the particle diameter of the toner particle and the reduction of the particle diameter of the toner particle. This makes it possible to manufacture the toner particles in high yield, of which particle diameter is uniform and small.

Further, in the invention, it is preferable that the pressure-resistant nozzle is a multiple nozzle.

Further, in the invention, it is preferable that the pressure-resistant nozzle is a nozzle having a liquid flowing passage therein provided with at least a collision wall against which a liquid flowing through the liquid flowing passage collides.

According to the invention, the multiple nozzle or the nozzle having the liquid flowing passage therein provided with at least a collision wall against which a passing liquid collides is used as the pressure-resistant nozzle, in a consequence whereof the toner particles can be stably reduced in size and moreover, it is possible to prevent the toner particles from undergoing coagulation and coarsening which are caused by mutual contact of the diameter-reduced toner particles.

Further, in the invention, it is preferable that at the depressurizing step, a pressure on the slurry is gradually reduced to a level at which no bubbling is caused by passing the pressurized slurry containing toner particles, which is cooled down at the cooling step, through a multistage depressurization apparatus for performing stepwise depressurization.

According to the invention, at the depressurizing step, the pressurized slurry containing toner particles, cooled down at the cooling step is made to pass through the multistage depressurization apparatus for performing stepwise depressurization, and the pressure on the slurry is gradually reduced to a level at which no bubbling is caused, in a consequence whereof the bubbling is further reliably prevented from being caused, thus obtaining a toner containing almost no coagulation of coarsened toner particles, which is formed by the influence of bubbles.

Further, in the invention, it is preferable that the multistage depressurization apparatus used at the depressurizing step comprises:

an inlet passage for leading the pressurized slurry containing toner particles into the depressurization apparatus;

an outlet passage in communication with the inlet passage, for discharging the slurry containing toner particles to outside of the depressurization apparatus; and a multistage depressurization section disposed between the inlet passage and the outlet passage, on which two or more depressurization members are coupled via coupling members, for performing stepwise depressurization.

According to the invention, at the depressurizing step, there is used the multistage depressurization apparatus comprising: the inlet passage for leading the pressurized slurry containing toner particles after completion of the cooling step; the outlet passage in communication with the inlet passage, for discharging the depressurized slurry containing toner particles to outside; and the multistage depressurization section disposed between the inlet passage and the outlet passage, on which two or more depressurization members are coupled via the coupling members, in a consequence whereof the pressure on the pressurized slurry containing toner particles can be smoothly reduced to a level at which no bubbling is caused.

Further, the invention provides a toner manufactured by any one of the above methods of manufacturing a toner.

According to the invention, the toner obtained by the manufacturing method of the invention is provided. As described above, the toner has various advantages such that the toner is excellent in image reproducibility and hard to cause the toner filming on a photoreceptor and the offset phenomenon in a high temperature, a transfer efficiency of the toner is high, and a consumption of the toner for image formation per one sheet is smaller than that of a conventional toner.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
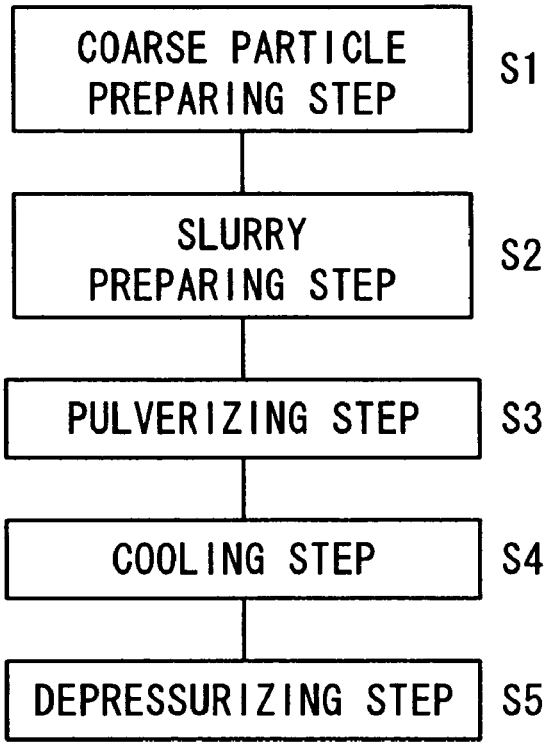
FIG. 1 is a flowchart showing a method of manufacturing a toner according to a first embodiment of the invention.

Now referring to the drawings, preferred embodiments of the invention are described below.

FIG. 1 is a flowchart showing a method of manufacturing a toner according to a first embodiment of the invention.

The manufacturing method according to the invention includes a coarse particle preparing step S1, a slurry preparing step S2, a pulverizing step S3, a cooling step S4, and a depressurizing step S5.

At the coarse particle preparing step S1, a melt-kneaded product of toner raw material is coarsely pulverized.

The toner raw material includes binder resin, a colorant, a releasing agent (wax), and a charge control agent.

As the binder resin, the selection of ingredients is not particularly limited as long as the ingredient can be granulated in its molten state, and it is thus possible to use heretofore known ingredients such as polyester, acrylic resin, polyurethane, and epoxy resin.

As polyester, heretofore known ingredients can be used, including a polycondensation of polybasic acid and polyhydric alcohol. As polybasic acid, those known as a monomer for polyester can be used, including: aromatic carboxylic acids such as terephthalic acid, isophthalic acid, phthalic acid anhydride, trimellitic acid anhydride, pyromellitic acid, and naphthalene dicarboxylic acid; aliphatic carboxylic acids such as maleic acid anhydride, fumaric acid, succinic acid, alkenyl succinic anhydride, and adipic acid; and a methyl-esterified compound of these polybasic acids. These polybasic acids may be used each alone or two or more of the polybasic acids may be used in combination. As polyhydric alcohol, those known as a monomer for polyester can also be used, including: aliphatic polyhydric alcohols such as ethylene glycol, propylene glycol, butane diol, hexane diol, neopentyl glycol, and glycerin; alicyclic polyhydric alcohols such as cyclohexane diol, cyclohexane dimethanol, and hydrogenated bisphenol A; and aromatic diols such as an ethylene oxide adduct of bisphenol A and a propylene oxide adduct of bisphenol A. These polyhydric alcohols may be used each alone or two or more of the polyhydric alcohols may be used in combination. Polycondensation reaction of polybasic acid and polyhydric alcohol can be effected in a common manner. For example, the polycondensation reaction is effected by contacting polybasic acid and polyhydric alcohol each other in the presence or absence of an organic solvent and under the presence of a polycondensation catalyst, and terminated at the instant when the acid value and the softening temperature of the resultant polyester stand at predetermined values. Polyester is thus obtained. In the case of using the methyl-esterified compound of polybasic acid as a part of polybasic acid, a de-methanol polycondensation reaction takes place. In the polycondensation reaction, by properly changing the blending ratio, the reaction rate, or other factors as to the polybasic acid and the polyhydric alcohol, it is possible to adjust, for example, the terminal carboxyl group content of polyester and thus denature a property of the resultant polyester. Further, in the case of using trimellitic anhydride as polybasic acid, the denatured polyester can be obtained also by facile introduction of a carboxyl group into a main chain of polyester.

As the acrylic resin, the selection of ingredients is not particularly limited, and acid group-containing acrylic resin can be preferably used. The acid group-containing acrylic resin can be produced, for example, by polymerization of acrylic resin monomers or polymerization of acrylic resin monomer and vinylic monomer with concurrent use of acidic group- or hydrophilic group-containing acrylic resin monomer and/or acidic group- or hydrophilic group-containing vinylic monomer. As the acrylic resin monomer, heretofore known ingredients can be used, including acrylic acid which may have a substituent, methacrylic acid which may have a substituent, acrylic acid ester which may have a substituent, and methacrylic acid ester which may have a substituent. The acrylic resin monomers may be used each alone or two or more of the acrylic resin monomers may be used in combination. Moreover, as the vinylic monomer, heretofore known ingredients can be used, including styrene, α-methylstyrene, vinyl bromide, vinyl chloride, vinyl acetate, acrylonitrile, and methacrylonitrile. These vinylic monomers may be used each alone or two or more of the vinylic monomers may be used in combination. The polymerization is effected by use of a commonly-used radical initiator in accordance with a solution polymerization method, a suspension polymerization method, an emulsification polymerization method, or the like method.

As the polyurethane, the selection of ingredients is not particularly limited, and acidic group- or basic group-containing polyurethane can be preferably used, for example. The acidic group- or basic group-containing polyurethane can be produced in accordance with a heretofore known method, for example, by subjecting acidic group- or basic group-containing diol, polyol, and polyisocyanate to an addition polymerization. Examples of the acidic group- or basic group-containing diol include dimethylol propionic acid and N-methyl diethanol amine. Examples of the polyol include polyether polyol such as polyethylene glycol, and polyester polyol, acryl polyol, and polybutadiene polyol. Examples of the polyisocyanate include tolylene diisocyanate, hexamethylene diisocyanate, and isophorone diisocyanate. These components may be used each alone or two or more of the components may be used in combination.

As the epoxy resin, the selection of ingredients is not particularly limited, and acidic group- or basic group-containing epoxy resin can be preferably used. The acidic group- or basic group-containing epoxy resin can be produced, for example, by addition or addition polymerization of polyvalent carboxylic acid such as adipic acid and trimellitic acid anhydride or amine such as dibutyl amine and ethylene diamine to epoxy resin which serves as a base.

Among these binder resins, polyester is preferred. Polyester is excellent in transparency and capable of providing the obtained toner particles with favorable powder flowability, low-temperature fixing property and secondary color reproducibility, thus being suitably used as binder resin for a color toner. Further, polyester and acrylic resin may also be used by grafting.

In the case where facilitation of granulating operation, a kneading property with the colorant, and equalization of shape and size of toner particles are taken into consideration, it is preferable to use binder resin having a softening temperature of 150° C. or lower, and particularly preferable to use binder resin having a softening temperature of from 60° C. to 150° C. Among such binder resins, preferred is binder resin of which weight-average molecular weight falls in a range of from 5,000 to 500,000.

The binder resins may be used each alone or two or more of the binder resins may be used in combination. Furthermore, it is possible to use a plurality of resins of the same type, which are different in any one or all of molecular weight, monomer composition, and other factors.

Note that, in a case of manufacturing a capsule toner according to the manufacturing method of the invention, binder resin intended for a core material and binder resin intended for forming an outer shell are used.

As the binder resin intended for a core material, preferred is resin containing one or two or more monomers of styrenes, maleic acid monoesters, and fumaric acid monoesters. A content of the styrene monomer in binder resin is preferably 30% to 95% by weight and more preferably 40% to 95% by weight, based on a total amount of the monomers. A content of the monomer of maleic acid monoesters and/or fumaric acid monoesters is preferably 5% to 70% by weight and more preferably 5% to 50% by weight, based on a total amount of the monomers.

Examples of the styrene monomer contained in the binder resin intended for a core material include styrene, α-methyl styrene, styrene halide, vinyl toluene, 4-Sulfonamide styrene, 4-styrene sulfonic acid, and divinylbenzene. Examples of the monomer of maleic acid monoesters include diethyl maleate, dipropyl maleate, dibutyl maleate, dipentyl maleate, dihexyl maleate, heptyl maleate, octyl maleate, ethylbutyl maleate, ethyloctyl maleate, butyloctyl maleate, butylhexyl maleate, and penetyloctyl maleate. Examples of the monomer of fumaric acid monoesters include diethyl fumarate, dipropyl fumarate, dibutyl fumarate, dipentyl fumarate, dihexyl fumarate, heptyl fumarate, octyl fumarate, ethylbutyl fumarate, ethyoctyl fumarate, butyloctyl fumarate, butylhexyl fumarate, and pentyloctyl fumarate.

Furthermore, in addition to the above-cited monomers, examples of the binder resin intended for a core material include a monomer of (meth)acrylic esters, a monomer of (meth)acrylamide alkyl sulfonic acids, a multifunctional (meth)acrylic monomer, and a monomer of peroxides.

Examples of the monomer of (meth)acrylic esters include methyl (meth)acrylate, ethyl(meth)acrylate, propyl(meth) acrylate, n-butyl(meth)acrylate, isobutyl(meth)acrylate, octyl(meth)acrylate, dodecyl(meth)acrylate, lauryl(meth) acrylate, stearyl(meth)acrylate, cyclohexyl(meth)acrylate, phenyl(meth)acrylate, benzyl(meth)acrylate, furfuryl(meth) acrylate, hydroxylethyl(meth)acrylate, hydroxybutyl(meth) acrylate, dimethylaminomethyl ester(meth)acrylate, dimethylaminoethyl ester(meth)acrylate, 2-ethylhexyl(meth) acrylate, and 2-chloroethyl(meth)acrylate.

Examples of the monomer of (meth)acrylamide alkyl sulfonic acids include acrylamidemethyl sulfonic acid, acrylamideethyl sulfonic acid, acrylamide n-propylsulfonic acid, acrylamide isopropylsulfonic acid, acrylamide n-butylsulfonic acid, acrylamide s-butylsulfonic acid, acrylamide t-butylsulfonic acid, acrylamide pentanesulfonic acid, acrylamide hexanesulfonic acid, acrylamide heptanesulfonic acid, acrylamide octanesulfonic acid, methacrylamide methylsulfonic acid, methacrylamide ethylsulfonic acid, methacrylamide n-propylsulfonic acid, methacrylamide isopropylsulfonic acid, methacrylamide n-butylsulfonic acid, methacrylamide s-butylsulfonic acid, methacrylamide t-butylsulfonic acid, methacrylamide pentanesulfonic acid, methacrylamide hexanesulfonic acid, methacrylamide heptanesulfonic acid, and methacrylamide octanesulfonic acid.

Examples of the multifunctional (meth)acrylic monomer include 1,3-butyleneglycol diacrylate, 1,5-pentanediol diacrylate, neopentylglycol diacrylate, 1,6-hexanediol diacrylate, diethyleneglycol diacrylate, triethyleneglycol diacrylate, tetraethyleneglycol diacrylate, polyethyleneglycol diacrylate, polyethyleneglycol #400 diacrylate, polyethylene glycol #600 diacrylate, polypropylene diacrylate, N,N'-methylene bisacrylamide, pentaerythritol triacrylate, trimethylolpropane triacrylate, tetramethylolpropane triacrylate, 1,4-butanediol diacrylate, diethyleneglycol dimethacrylate, 1,3-butyleneglycol dimethacrylate, 1,5-pentanediol dimethacrylate, neopentylglycol dimethacrylate, 1,6-hexanediol dimethacrylate, diethyleneglycol dimethacrylate, triethyleneglycol dimethacrylate, tetraethyleneglycol dimethacrylate, polyethyleneglycol dimethacrylate, polyethyleneglycol #400 dimethacrylate, polyethyleneglycol #600 dimethacrylate, polypropylene dimethacrylate, N,N'-methylene bismethacrylamide, pentaerythritol trimethacrylate, trimethylolpropane trimethacrylate, tetramethylolpropane trimethacrylate, 1,4-butanediol dimethacrylate, 2,2-bis(4-methacryloxy polyethoxyphenyl)propane, aluminum methacrylate, calcium methacrylate, zinc methacrylate, and magnesium methacrylate.

Examples of the monomer of peroxides include t-butylperoxy methacrylate, t-butylperoxy crotonate, di(t-butylperoxy)fumarate, t-butylperoxy allylcarbonate, pertrimellitic acid tri-t-butyl ester, pertrimellitic acid tri-t-aminoester, pertrimellitic acid tri-t-hexyl ester, pertrimellitic acid tri-t-1,1,3,3-tetramethyl butyl ester, pertrimellitic acid tri-t-cumyl ester, pertrimellitic acid tri-t-(p-isopropyl)cumyl ester, pertrimesic acid tri-t-butyl ester, pertrimesic acid tri-t-amino ester, pertrimesic acid tri-t-hexyl ester, pertrimesic acid tri-t-1,1,3,3-tetramethyl butyl ester, pertrimesic acid tri-t-cumyl ester, pertrimesic acid tri-t-(p-isopropyl)cumyl ester, 2,2-bis(4,4-di-t-butylperoxycyclohexyl)propane, 2,2-bis(4,4-di-t-hexylperoxycyclohexyl)propane, 2,2-bis(4,4-di-t-amylperoxycyclohexyl)propane, 2,2-bis(4,4-di-t-octylperoxycyclohexyl) propane, 2,2-bis(4,4-di-t-α-cumylperoxycyclohexyl) propane, 2,2-bis(4,4-di-t-butylperoxycyclohexyl)butane, and 2,2-bis(4,4-di-t-octylperoxycyclohexyl)butane.

It is preferred that the binder resin intended for a core material be formed by two-stage polymerization of one or two or more of the above monomers. The two-stage polymerization can be effected by a solution polymerization method, a suspension polymerization method, an emulsification polymerization method, and the like method, among which the solution polymerization method is preferable. A molecular weight distribution curve of binder resin obtained by the two-stage polymerization shows at least two peaks, that is, at least one in a low-molecular range and one in a high-molecular range.

The core material may contain, as well as the above binder resin, styrene-acrylic resin, polyurethane, styrene-butadiene resin, polyester, and epoxy, for example.

Meanwhile, the outer shell is formed of thermoplastic resin which includes a vinylic polymer, polyester, epoxy resin, and polyurethane. Among these ingredients, the vinylic polymer and polyester are preferred. To be more specific, a styrene-n-butylacrylate copolymer, a styrene-methylmethacrylate-n-butylmethacrylate copolymer, and a condensation product of terephthalate-bisphenol A propylene oxide can be cited.

As the colorant, it is possible to use an organic dye, an organic pigment, an inorganic dye, and an inorganic pigments, which are commonly used in the electrophotographic field.

A black colorant includes, for example, carbon black, copper oxide, manganese dioxide, aniline black, activated carbon, non-magnetic ferrite, magnetic ferrite, and magnetite.

An yellow colorant includes, for example, yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

An orange colorant includes, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

A red colorant includes, for example, red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

A purple colorant includes, for example, manganese purple, fast violet B, and methyl violet lake.

A blue colorant includes, for example, Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

A green colorant includes, for example, chromium green, chromium oxide, pigment green B, malachite green lake, final yellow green G, and C.I. pigment green 7.

A white colorant includes, for example, those compound such as zinc white, titanium oxide, antimony white, and zinc sulfide.

The colorants may be used each alone or two or more of the colorants of different colors may be used in combination. Further, two or more of the colorants with the same color may be used in combination.

A use ratio of the binder resin to the colorant is not limited to a particular ratio. A typical usage of the colorant is preferably from 0.1 to 20 parts by weight, and more preferably from 0.2 to 10 parts by weight based on 100 parts by weight of the binder resin.

As the releasing agent, it is possible to use ingredients which are commonly used in this field, including: petroleum wax such as paraffin wax, a derivative thereof, microcrystalline wax, and a derivative thereof; hydrocarbon synthesis wax such as Fischer-Tropsch wax, a derivative thereof, polyolefin wax, a derivative thereof, low-molecular polypropylene wax, a derivative thereof, polyolefin copolymer wax (low-molecular polyethylene wax etc.), and a derivative thereof; plant-derived wax such as carnauba wax, a derivative thereof, rice wax, a derivative thereof, candelilla wax, a derivative thereof, and wood wax; animal-derived wax such as bee wax and whale wax; oil and fat synthesis wax such as fatty acid amide and phenol fatty acid ester; long-chain carboxylic acid and a derivative thereof; long-chain alcohol and a derivative thereof; silicone copolymer; and higher fatty acid. Note that the derivative includes an oxide, a block copolymer of a vinylic monomer and wax, and a graft denatured product of a vinylic monomer and wax. A usage of the wax is not limited to a particular level and may be selected as appropriate from a wide range. A preferable usage of the wax is 0.2 to 20 parts by weight based on 100 parts by weight of the binder resin.

As the charge control agent, it is possible to use agents for controlling positive charges and agents for controlling negative charges, which are commonly used in this field. The charge control agent for controlling positive charges includes a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The charge control agent for controlling negative charges includes oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a fatty acid soap, long-chain alkylcarboxylic acid salt, and a resin acid soap. The charge control agent may be used each alone and according to need, two or more of the agents may be used in combination. A usage of the charge control agent is not limited to a particular level and may be selected as appropriate from a wide range. A preferable usage of the charge control agent is 0.5 to 3 parts by weight based on 100 parts by weight of the binder resin.

Furthermore, the toner raw material may contain, as necessary, a commonly-used additive for toner.

The melt-kneaded product of toner raw material can be produced, for example, by dry-mixing various toner raw materials in a mixer, and then melt-kneading them under heat at a temperature (usually about 80° C. to 200° C., preferably about 100° C. to 150° C.) which is equal to or higher than the melting temperature of the binder resin. Usable mixers includes heretofore known mixers including Henschel-type mixing apparatuses such as a Henschel mixer (trade name) manufactured by Mitsui Mining Co., a super mixer (trade name) manufactured by Kawata Co., and a MECHANO mill (trade name) manufactured by Okada Seiko Co., ONGU mill (trade name) manufactured by Hosokawa Micron Co., Hybridization system (trade name) manufactured by Nara Kikai Seisakusho Co., and Cosmo system (trade name) manufactured by Kawasaki Heavy Industry Co. For melt-kneading, it is possible to use commonly-used kneading machines such as a twin-screw extruder, three rolls, and laboplast mill. To be more specific, usable kneading machines include single or twine screw extruders such as TEM-100B (trade name) manufactured by Toshiba Kikai Co., PCM-65/87 (trade name) manufactured by Ikegai Co., and open roll-systems such as Kneadics (trade name) manufactured by Mitsui Mining Co. The melt-kneaded product of toner raw material is cooled down to be solidified.

The cooled and solidified product obtained from the melt-kneaded product of toner raw material is coarsely pulverized by use of a particle pulverizer such as a cutter mill, a feather mill, and a jet mill so that coarse particles of the toner raw material are obtained. A particle diameter of the coarse particle is not limited to a particular size, and set to be preferably 450 μm to 1000 μm, and more preferably around 500 μm to 800 μm.

At the slurry preparing step S2, the coarse particles of toner raw material (hereinafter referred to as "toner coarse particles") which are obtained at the coarse particle preparing step, is mixed with a liquid so that the toner coarse particles are dispersed in the liquid, whereby slurry of the toner coarse particles is prepared.

The liquid being mixed with the toner coarse particles is not limited to a particular liquid as long as the liquid allows the toner coarse particles to be not dissolved therein but evenly dispersed therein. In view of ease of the controls over the steps and the waste liquid disposal after completion of all the steps, water is preferably selected as the liquid, and more preferable is water containing a water-soluble polymeric dispersant. The water-soluble polymeric dispersant has been preferably added to water in advance before the toner coarse particles are added to the water. An addition amount of the water-soluble polymeric dispersant is not limited to a particular amount, and the addition amount is preferably 0.05% to 10% by weight and more preferably 0.1% to 3% by weight of a total amount of the water and water-soluble polymeric dispersant.

Examples of the water-soluble polymeric dispersant include: polyoxyethylene polymers such as (meth)acrylic polymer, polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester; cellulose polymers such as methylcellulose, hydroxyethylcellulose, and hydroxypropylcellulose; polyoxyalkylene alkylarylether sulfate salts such as sodium polyoxyethylene laurylphenylether sulfate, potassium polyoxyethylene laurylphenylether sulfate, sodium polyoxyethylene nonylphenylether sulfate, sodium polyoxyethylene oleylphenylether sulfate, sodium polyoxyethylene cetylphenylether sulfate, ammonium polyoxyethylene laurylphenylether sulfate, ammonium polyoxyethylene nonylphenylether sulfate, and ammonium polyoxyethylene oleylphenylether sulfate; and polyoxyalkylene alkylether sulfate salts such as sodium polyoxyethylene laurylether sulfate, potassium polyoxyethylene laurylether sulfate, sodium polyoxyethylene oleylether sulfate, sodium polyoxyethylene cetylether sulfate, ammonium polyoxyethylene laurylether sulfate, and ammonium polyoxyethylene oleylether sulfate, which contains one or two hydrophilic monomers selected from: acrylic monomers such as (meth)acrylic acid, α-cyanoacrylate, α-cyanomethacrylate, itaconic acid, crotonic acid, fumaric acid, maleic acid, and maleic acid anhydride; hydroxyl-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester monomers such as diethylene glycol monoacrylic ester, diethylene glycol monomethacrylic ester, glycerine monoacrylic ester, and glycerine monomethacrylic ester; vinyl alcohol monomers such as N-methylol acrylamide and N-methylol methacrylamide; vinylalkylether monomers such as vinylmethylether, vinylethylether, and vinylpropylether; vinylalkylester monomers such as vinyl acetate, vinyl propionate, and vinyl butyrate; aromatic vinyl monomers such as styrene, α-methylstyrene, and vinyl toluene; amide monomers such as acrylamide, methacrylamide, diacetone acrylamide, and methylol compounds thereof; nitrile monomers such as acrylonitrile and methacrylonitorile; acid chloride monomers such as chloride acrylate and chloride methacrylate; vinyl nitrogen-containing heterocyclic monomers such as vinylpyridine, vinylpyrrolidone, vinylimidazole, and ethyleneimine; and cross-linking monomers such as ethyleneglycol dimethacrylate, diethyleneglycol dimethacrylate, allyl methacrylate, and divinylbenzene. The water-soluble polymeric dispersants may be used each alone or two or more dispersants may be used in combination.

Further, in manufacturing the capsule toner, it is preferred that methanol be added together with the water-soluble polymeric dispersant. An addition amount of methanol is not limited to a particular amount, and the addition amount of methanol is preferably 1% to 5% by weight of a total amount of the water and methanol. As in the case of the water-soluble polymeric dispersant, methanol has been also preferably added to water in advance before the toner coarse particles are added to the water.

The mixing of the toner coarse particles and the liquid is conducted by use of a commonly-used mixer so that slurry of the toner coarse particles is obtained. An addition amount of the toner coarse particles relative to the liquid is not limited to a particular amount, and the amount of the toner coarse particles is preferably 3% to 45% by weight and more preferably 5% to 30% by weight of a total amount of the toner coarse particles and liquid. Furthermore, the mixing of the toner coarse particles and water may be conducted under heating or cooling though usually conducted at a room temperature.

The slurry of toner coarse particles thus obtained may be directly subjected to a process at the pulverizing step S3, or alternatively, may be subjected to a commonly-used coarse particle pulverizing process, for example, as a pretreatment, such as pulverizing the toner coarse particles to have a particle diameter of preferably around 100 μm, and more preferably 100 μm or less. The coarse particle pulverizing process is performed, for example, by letting the slurry of toner coarse particles pass under high pressure through a nozzle.

At the pulverizing step S3, the slurry of toner coarse particles obtained at the slurry preparing step S2 is made to pass under heat and pressure through a pressure-resistant nozzle, whereby the toner coarse particles are pulverized into toner particles, resulting in slurry of toner particles.

A pressurizing and heating condition for the slurry of toner coarse particles is not limited to a particular condition. The slurry is preferably pressurized at 50 to 250 MPa and heated to be 50° C. or more, and more preferably pressurized at 50 to 250 MPa and heated to be 90° C. or more, and furthermore preferably pressurized at 50 to 250 MPa and heated to be a temperature between 90° C. and (Tm+25)° C. (wherein Tm represents a half softening temperature measured by a flow tester). Pressure below 50 MPa causes the shearing energy to be small, which possibly leads insufficient reduction of the particle diameter. Pressure above 250 MPa excessively increases a degree of risk in an actual production line, thus being unrealistic. The slurry of toner coarse particles is lead at pressure and temperature falling in the above-stated ranges, from the inlet of the pressure-resistant nozzle into the pressure-resistant nozzle.

As the pressure-resistant nozzle, it is possible to use a commonly-used pressure-resistant nozzle through which a liquid can flow. A preferably-used pressure-resistant nozzle is, for example, a multiple nozzle having a plurality of liquid flowing passages. The liquid flowing passages of the multiple nozzle may be arranged in form of a concentric circle of which center is a shaft of the multiple nozzle. Alternatively, the liquid flowing passages may be arranged in substantially parallel with a longitudinal direction of the multiple nozzle. One example of the multiple nozzle being used in the manufacturing method of the invention is a nozzle having one or a plurality of liquid flowing passages, preferably having around one or two liquid flowing passages, each of which is around 0.05 to 0.35 mm in inlet diameter and outlet diameter and 0.5 to 5 cm in length.

Figure 2:
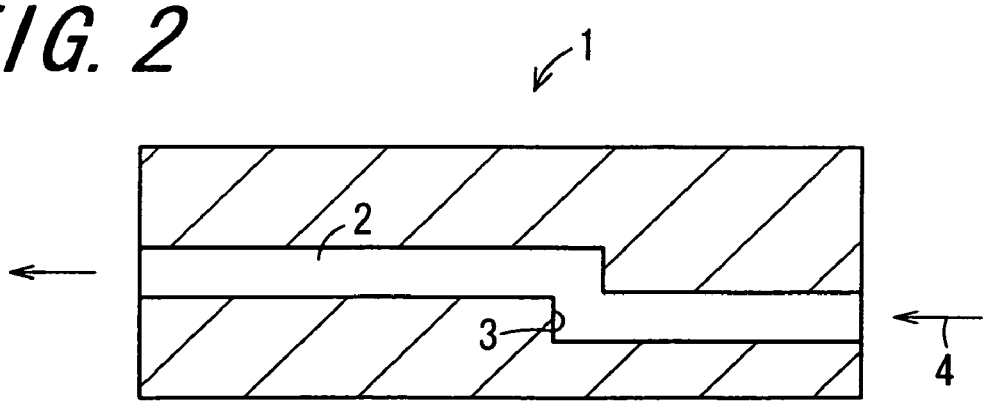
FIG. 2 is a sectional view schematically showing a configuration of a pressure-resistant nozzle.

A pressure-resistant nozzle shown in FIG. 2 is usable. FIG. 2 is a sectional view schematically showing a configuration of a pressure-resistant nozzle 1. The pressure-resistant nozzle 1 has a liquid flowing passage 2 therein, which is bent into a hook shape. The pressure-resistant nozzle 1 further has at least one collision wall 3 against which the slurry containing toner coarse particles flowing in an arrow 4 direction into the flowing passage collides. The slurry containing toner coarse particles collides against the collision wall 3 at a substantially right angle, thereby causing the toner coarse particles to be pulverized into smaller toner particles which are then discharged from the pressure-resistant nozzle 1.

The slurry discharged from the outlet of the pressure-resistant nozzle contains toner particles having a reduced diameter around 3.5 to 6.5 μm, for example. The slurry is heated to be a temperature between 60° C. and (Tm+60)° C. (Tm is the same as the above-mentioned), and pressurized at around 10 to 50 MPa.

The number of the pressure-resistant nozzle being disposed may be one or plural.

At the cooling step S4, the heated and pressurized slurry containing diameter-reduced toner particles obtained at the pulverizing step S3 is cooled down. At the cooling step S4, the diameter-reduced toner particle-containing slurry discharged from the pressure-resistant nozzle at the previous step is cooled down. A cooling temperature is not limited. As an indication, when the slurry is cooled down to a liquid temperature of 30° C. or lower, for example, pressure imparted to the slurry is reduced to a level around 5 to 80 MPa.

For the cooling, it is possible to use any of commonly-used liquid cooling machines having a pressure-resistant structure. Among such cooling machines, preferred is a cooling machine having a large cooling area, such as a corrugated tube-type cooling machine. Further, the cooling machine is preferably configured so that a cooling gradient (or cooling capacity) is smaller from an inlet to an outlet of the cooling machine. This is because such a configuration contributes to more effective achievements of reduction in diameter of wax, even dispersion of the diameter-reduced wax in the toner particles, and the like factors. Further, coarsening of the toner particles, which is caused by mutual reattachment of the toner particles, is prevented, allowing enhancement in yield of the diameter-reduced toner particles.

The diameter-reduced toner particle-containing slurry discharged from the pressure-resistant nozzle at the previous step is, for example, lead from the inlet of the cooling machine into the cooling machine, and then subjected to the cooling inside the cooling machine having a cooling gradient, followed by being discharged from the outlet of the cooling machine. The number of the cooling machine being disposed may be one or plural.

At the depressurizing step S5, the pressure on the pressurized slurry containing toner particles obtained at the cooling step S4 is reduced to a level at which no bubbling (generation of bubbles) is caused. The slurry being shifted from the cooling step S4 to the depressurizing step S5 is pressurized at around 5 to 80 MPa. It is preferred that the depressurization be gradually carried out in a stepwise manner.

For the depressurizing operation, it is preferable to use a multistage depressurization apparatus stated in WO03/059497. The multistage depressurization apparatus comprises an inlet passage for leading pressurized slurry containing toner particles into the multistage depressurization apparatus, an outlet passage in communication with the inlet passage, for discharging the depressurized slurry containing toner particles to outside of the multistage depressurization apparatus, and a multistage depressurization section disposed between the inlet passage and the outlet passage, on which two or more depressurization members are coupled via coupling members.

For example, between a part designed for the cooling step S4 and a part designed for the depressurizing step S5 is provided a pressure-resistant pipe on which a supply pump and a supply valve are provided, whereby the pressurized slurry containing toner particles obtained at the cooling step S4 is transferred to the part designed for the depressurization step S5. The slurry is thus led into the inlet passage of the multistage depressurization apparatus.

The depressurization member used for the multistage depressurization section in the multistage depressurization apparatus includes a pipe-shaped member, for example. The coupling member includes a ring-shaped seal, for example. The multistage depressurization section is configured by coupling a plurality of the pipe-shaped members having different inner diameters on each other by the ring-shaped seals. For example, two to four pipe-shaped members having the same inner diameters are coupled on each other from the inlet passage toward the outlet passage. On these pipe-shaped members is then coupled one pipe-shaped member having an inner diameter which is about twice as large as the inner diameter of these pipe-shaped members. Furthermore, on those pipe-shaped members are coupled about one to three pipe-shaped members having an inner diameter which is about 5% to 20% smaller than the inner diameter of the one pipe-shaped member. By so doing, the slurry containing toner particles, which flows inside the pipe-shaped members is gradually depressurized to a final pressure level at which no bubbling is caused, preferably to a level of air pressure.

A heat exchanging section using a cooling medium or heating medium may be disposed around the multistage depressurization section so that cooling or heating is conducted in accordance with a level of pressure imparted to the slurry containing toner particles.

The slurry containing toner particles, which is depressurized inside the multistage depressurization apparatus is discharged from the outlet passage to outside of the multistage depressurization apparatus.

The number of the multistage depressurization apparatuses being disposed may be one or plural.

The slurry containing diameter-reduced toner particles is thus obtained. The diameter-reduced toner particles are isolated from the slurry by a commonly-used separating apparatus such as filtration and centrifugal separation, and when needed, subjected to cleaning through pure water, ion water, etc., followed by drying. The toner containing diameter-reduced toner particles of the invention is thus obtained.

The toner of the invention is formed of toner particles which have a reduced diameter of about 3.5 to 6.5 μm and in which diameter-reduced wax is evenly dispersed. The toner of the invention has advantages such as being excellent in image reproducibility and causing no problems of various types attributable to bleeding out of wax.

Note that, in the manufacturing method of the invention, the steps through step S1 to step S5 may be carried out only one time, or alternatively, the steps through step S3 to step S5 may be repeated after one-time implementation of the steps through step S1 to step S5.

EXAMPLE

Hereinafter, the invention will be described more in detail with reference to Example.

Example 1

There were provided 87.5 parts by weight of polyester resin (having a weight-average molecular weight of 80,000 and Mw/Mn of 24), 1.5 parts by weight of a charge control agent: TRH (trade name) manufactured by Hodogaya Chemical Co., Ltd., 3 parts by weight of polyester wax (having a melting temperature of 85° C.), and 8 parts by weight of a colorant: KET. BLUE 111 (trade name). These constituent components have been mixed by using a mixer: Henschel Mixer (trade name) manufactured by Mitsui Mining Co., Ltd. to obtain a toner raw material admixture. Next, the obtained toner raw material admixture was melt-kneaded by using a twin-screw extruder: PCM-30 (trade name) manufactured by Ikegai Co., Ltd. under cylinder setting temperature of 145° C. and barrel rotational speed of 300 rpm to prepare a melt-kneaded product of toner raw material. The melt-kneaded product was then cooled down to a room temperature, thereafter being coarsely pulverized by a cutter mill: VM-16 (trade name) manufactured by Orient Co., Ltd. to prepare toner coarse particles having a particle diameter of 500 to 800 μm.

Next, 94 parts by weight of the toner raw material coarse particles obtained as described above and 20 parts by weight of an aqueous solution containing 30% by weight of a polymeric dispersant: Joncryl 70 (trade name) manufactured by Johnson Polymer Corporation were mixed to prepare water-based slurry of toner coarse particles. The water-based slurry was made to pass under pressure of 168 MPa through a nozzle having an inner diameter of 0.3 mm, whereby the pretreatment was applied so that a particle diameter of the toner coarse particles contained in the water-based slurry was adjusted to be 100 μm or less.

The water-based slurry of the toner coarse particles obtained as described above was pressurized at 210 MPa and heated to 70° C. inside a pressure-resistant airtight container, and then supplied from a pressure-resistant pipe mounted on the pressure-resistant airtight container to a pressure-resistant nozzle mounted on an outlet of the pressure-resistant pipe. The pressure-resistant nozzle is a pressure-resistant multiple nozzle having a length of 0.5 cm, which is configured so that two liquid flowing holes having a hole diameter of 0.085 mm are substantially parallel to each other in a longitudinal direction of the nozzle. At an inlet of the nozzle, a temperature of the water-based slurry was 70° C., and pressure imparted to the water-based slurry was 210 MPa. At an outlet of the nozzle, a temperature of the water-based slurry was 120° C., and pressure imparted to-the water-based slurry was 42 MPa. The water-based slurry discharged from the pressure-resistant nozzle was led into a corrugated tube-type cooling machine connected to the outlet of the pressure-resistant nozzle, where cooling was carried out. At an outlet of the cooling machine, a temperature of the water-based slurry was 30° C., and pressure imparted to the water-based slurry was 35 MPa. The water-based slurry discharged from the outlet of the cooling machine was led into the multistage depressurization apparatus connected to the outlet of the cooling machine, where depressurization was conducted. The water-based slurry discharged from the multistage depressurization apparatus contained toner particles having a particle diameter of 3.5 to 6.5 μm.

The toner particles were filtered out of the water-based slurry, and subjected to cleaning by use of pure water, followed by drying. The toner of the invention was thus manufactured.

The following performance tests were conducted on the toner of the invention obtained as described above.

[Image Density]

The obtained toner was put in a developer tank of developing device of testing image forming apparatus to thereby form an unfixed test image including a solid image part, such that a toner amount attached to a sheet designed only for full color: PP106A4C (trade name) manufactured by Sharp Corporation (hereinafter referred to simply as "recording sheet") was 0.6 mg/cm$^2$. As the testing image forming apparatus, there was used a commercially available image forming apparatus: AR-C150 digital full color multifunction printer (trade name) manufactured by Sharp Corporation, of which fixing device was removed as a result of remodeling of a developing device into a device for non-magnetic one-component developer.

The unfixed image formed was fixed by an external fixing machine. An image thus obtained was used as an evaluation image. As the external fixing machine, there was used an oil-less fixing device which was taken out from a commercially available image forming apparatus: AR-C160 digital full color multifunction printer (trade name) manufactured by Sharp Corporation. The oil-less fixing device section means a fixing device which performs fixing without applying a releasing agent onto a heating roller.

An optical density of the solid image part in the evaluation image thus obtained was measured. The measurement was conducted by use of a spectral calorimetric densitometer: X-Rite 938 (trade name) manufactured by Nippon Heiban Insatsukizai Co. All optical densities measured on 100 samples were 1.40 or more. It was thus turned out that the image density was very high.

[Fogging Level]

At the outset, whiteness defined by JIS P8148 on an A4-sized recording sheet (PP106A4C) defined by JIS P0138 was measured by use of a whiteness checker: Z-Σ90 Color Measuring System (trade name) manufactured by Nippon Denshoku Industries Co., Ltd. The obtained value was defined as a first measurement value W1.

The toner of the invention was put in a developing tank of developing device of commercially available digital multifunction printer: AR-620 (trade name) manufactured by Sharp Corporation, to thereby form an evaluation image containing a while circle part having a diameter of 55 mm and a black solid part surrounding the while circle part onto three recording sheets of which whiteness had been measured. By use of the above-described whiteness checker, whiteness of the white circle part on each of the evaluation images was measured, and an average thereof was then calculated. The obtained value was defined as a second measurement value W2. A fogging density W(%) was calculated based on the following formula using the first measurement value W1 and the second measurement value W2:

$$W(\%)=[(W1-W2)/W1]\times 100$$

All the fogging densities W calculated on 100 samples were 1.0% or less. It was thus obvious that fogging was hard to be caused.

[Transferring Property]

The toner of the invention was put in a developer tank of developing device of commercially available digital multifunction printer: AR-620 (trade name) manufactured by Sharp Corporation, to thereby make a copy of a predetermined chart containing a solid image part onto a recording sheet (PP106A4C). A weight Mp (mg/cm$^2$) of transferred toner (hereinafter referred to as "transferred toner amount") in the solid image part per section area of the recording sheet was then measured. Moreover, a weight Md (mg/cm$^2$) of remaining toner (hereinafter referred to as "remaining toner amount") per section area in a part of a photoreceptor used for making the copy, where the solid image part had been formed, was measured. The weight of toner was measured under circumstances of a temperature of 20° C. and a relative humidity of 50% RH. A transfer ratio T(%) was calculated based on the following formula using the measured transferred toner amount Mp and remaining toner amount Md:

$$T(\%)=[Mp/(Md+Mp)]\times 100$$

All the transfer ratios T calculated on 100 samples were 90% or more. It was thus turned out that the toner had a very excellent transfer ratio.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner comprising:

preparing a coarse toner particle by coarsely pulverizing a melt-kneaded product of toner raw material;

adding and dispersing the coarse toner particles in a water to obtain a slurry;

passing and pulverizing said slurry through a pressure-resistant nozzle under heat and pressure of 50 to 250 MPa and pulverizing the coarse particles of toner raw material to obtain a heated and pressurized slurry containing toner particles;

cooling down the heated and pressurized slurry containing toner particles to obtain a pressurized slurry containing toner particles; and depressurizing the pressurized slurry containing toner particles in a multistage section to a lower pressure level with no generation of bubbles, wherein the toner raw material includes a binder resin, a colorant, a releasing agent, and a charge control agent.

2. The method of claim 1, wherein the water is a water containing a polymeric dispersant.

3. The method of claim 1, wherein the heated and pressurized slurry is heated to 50° C. or more.

4. The method of claim 1, wherein the heated and pressurized slurry is heated to 90° C. or more.

5. The method of claim 1, wherein the pressure-resistant nozzle is a multiple nozzle.

6. The method of claim 1, wherein the pressure-resistant nozzle is a nozzle having a liquid flowing passage therein provided with at least a collision wall against which a liquid flowing through the liquid flowing passage collides.

7. The method of claim 1, wherein the depressurizing step comprises passing the pressurized slurry containing toner particles through a multistage depressurization apparatus for performing stepwise depressurization.

8. A method of manufacturing a toner comprising:

preparing a coarse toner particle by coarsely pulverizing a melt-kneaded product of toner raw material;

adding and dispersing the coarse toner particles in a liquid to obtain a slurry;

passing and pulverizing said slurry through a pressure-resistant nozzle under heat and pressure and pulverizing the coarse particles of toner raw material to obtain a heated and pressurized slurry containing toner particles;

cooling down the heated and pressurized slurry containing toner particles to obtain a pressurized slurry containing toner particles; and depressurizing the pressurized slurry containing toner particles in a multistage depressurization section to a lower pressure level with no generation of bubbles, wherein the multistage depressurization section is a multistage depressurization apparatus used at the depressurizing step comprises:

an inlet passage for leading the pressurized slurry containing toner particles into the depressurization apparatus;

an outlet passage in communication with the inlet passage, for discharging the slurry containing toner particles to outside of the depressurization apparatus; and a multistage depressurization section disposed between the inlet passage and the outlet passage, on which two or more depressurization members are coupled via coupling members, for performing stepwise depressurization.

* * * * *